US005247990A

United States Patent [19]

Sudol et al.

[11] Patent Number: 5,247,990

[45] Date of Patent: Sep. 28, 1993

[54] CENTRALIZER

[76] Inventors: Tad A. Sudol, 11724 University Avenue, Edmonton, Alberta, Canada, T6G 1Z5; Dzung Nguyen, 194 Chrenek Acres, Sherwood Park, Alberta, Canada, T8B 1H5

[21] Appl. No.: 849,762

[22] Filed: Mar. 12, 1992

[51] Int. Cl.[5] ..... E21B 17/10

[52] U.S. Cl. ..... 166/241.3; 166/241.4

[58] Field of Search ..... 166/241.3, 241.4, 241.2, 166/176, 378

[56] References Cited

U.S. PATENT DOCUMENTS

| | | | |
|---|---|---|---|
| 3,058,524 | 10/1962 | Tripplehorn | 166/176 |
| 4,182,537 | 1/1980 | Oster | 166/241.3 |
| 4,589,484 | 5/1986 | Doherty et al. | 166/179 |
| 4,632,468 | 12/1986 | Wilson et al. | 166/241.4 |
| 4,688,636 | 8/1987 | Hennessey | 166/241 |
| 4,757,861 | 7/1988 | Klyne | 166/241.3 |
| 4,787,457 | 11/1988 | Webster et al. | 166/286 |
| 4,830,105 | 5/1989 | Petermann | 166/241 |
| 4,871,020 | 10/1989 | Rivas et al. | 166/241 |
| 4,875,524 | 10/1989 | Bradley et al. | 166/241 |
| 4,913,230 | 4/1990 | Rivas et al. | 166/241 |
| 4,938,299 | 7/1990 | Jelsma | 175/73 |
| 4,974,691 | 12/1990 | Leaney | 175/325 |
| 4,997,039 | 3/1991 | Sable | 166/241 |
| 5,048,619 | 9/1991 | Leaney | 175/40 |

FOREIGN PATENT DOCUMENTS

| | | | |
|---|---|---|---|
| 840276 | 6/1981 | U.S.S.R. | 166/241.3 |

*Primary Examiner*—Hoang C. Dang

*Attorney, Agent, or Firm*—St. Onge Steward Johnston & Reens

[57] ABSTRACT

A centralizer for downhole sucker rods such as those used in oil wells. The centralizer has a central axial aperture for rotatable mounting on a downhole rod of a rod string. The exterior surface of the centralizer is shaped to engage the well wall when brought into contact with the wall such that rotational movement of the centralizer is limited or stopped with respect to the wall. Generally, the exterior of the centralizer is shaped to match the shape of the wall of the well in which it is to be used. A centralizer for use with a well lined with a circular tubing thus has at least one exterior surface which in cross section defines an arc having a radius of curvature equal to that of the tubing interior. A disclosed embodiment has six lobes having surfaces defining in cross section portions of three such arcs arranged symmetrically about the central aperture.

16 Claims, 6 Drawing Sheets

CENTRALIZER

FIELD OF THE INVENTION

This invention relates to centralizers for rotational downhole sucker rods such as those used in oil

BACKGROUND OF THE INVENTION

It is known in the oil industry to use a rotating sucker rod string to operate a downhole pump known as a progressive cavity pump. Such a pump is commonly used in primary production from an oil reservoir or possibly to pump water from a gas well, etc. These pumps are useful because of their ability to pump viscous fluids and fluids containing significant amounts of solids. The rod string is generally located within a well tubing of circular cross section lining the well shaft of a well and the string is rotated by a geared mechanism atop the well. Crude oil passes upwardly through the gap between the string and tubing to ground level during well operation.

Torsional forces are loaded onto the string during well operation and this arrangement can lead to a warping of the string such that portions of the rotating string rub directly against the well tubing. Typically string deformation is such that a rod rubs against a localized area of the tubing rather than the entire inner circumference of the tubing. Such rubbing thus leads to local wear of the tubing and rod and is generally undesirable. It is also possible for such rubbing to arise due to a crooked tubing or tubing deliberately deviated during installation.

An approach to combatting this wearing problem has been the use of centralizers located on the string at axially spaced locations. There is known in the oil industry a centralizer having a hollow circular center. It has an outer diameter having a cross section exceeding that of the rod on which it is mounted but which is smaller than the interior diameter of the tubing within which it is located. The outer diametrical cross section defines arc portions which lie on a common circle centered on a central axis of the hollow center. As a string becomes deformed or if the well tubing is crooked, for example, one or more of the centralizers will come into contact with the tubing and direct contact between the string and tubing is prevented. The arrangement is such that, as the centralizer comes into contact with the tubing, the centralizer rotates with the string and thus rubs against the stationary tubing. The rubbing of the rotating centralizer against the stationary tubing damages the tubing reducing its life.

The use of a centralizer mounted to be capable of rotation with respect to the rod, and which does not rotate with the rod when the centralizer is in contact with the well tubing, may reduce tubing wear and thereby extend tubing lifetime.

GENERAL DESCRIPTION OF THE INVENTION

The present invention thus provides a centralizer for a rod of a rotatable downhole rod string of a well. The centralizer has an opening so that it may be rotatably mounted on the rod and the centralizer has at least one exterior surface shaped to engage the well wall which, when brought into abutting contact therewith, will limit rotational movement of the centralizer with respect to the wall as the rod to which it is mounted rotates.

In certain preferred embodiments, described further below, the centralizer includes lobes which define the exterior surfaces. Preferrably, the surfaces on neighbouring lobes are shaped to match, or nearly match, the contour of the interior of the wall or tubing of the well in which the centralizer is t be used.

In a particular embodiment, the centralizer is for use in a well having a tubing of circular cross section and for mounting on a rod of circular outer cross section. In this aspect, the centralizer of the present invention has a central axial bore for rotatable mounting of the centralizer on the rod. The cross dimension of the centralizer is smaller than the interior diameter of the tubing so that a centralizer centered in the tubing does not necessarily contact the tubing. The centralizer has a plurality of lobes, each of which defines an outer surface for abutment of the tubing and a cross section such that surfaces of neighbouring lobes define portions of a convex arc tangential to a circle concentric with the central axis of the bore. The radius of curvature of the arc is greater than the radius of curvature of the circle Preferably, the curvature of the arc matches the curvature of the well tubing so that the contour of the centralizer surfaces brought into contact with the tubing during operation of the well match the contour of the interior surface of the tubing

Figure 7:
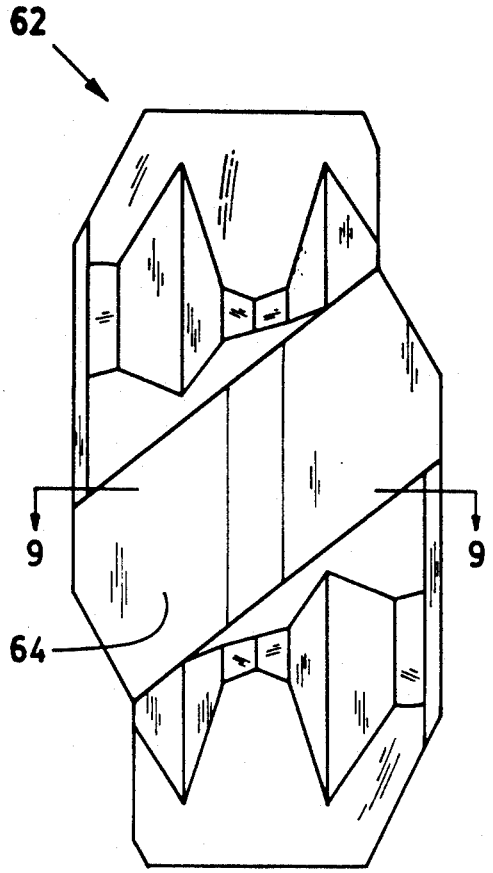
FIG. 7 is a side elevation of a second embodiment centralizer of the present invention.
Figure 8:
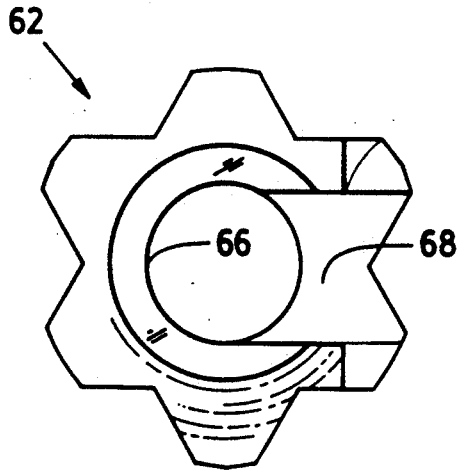
Figure 9:
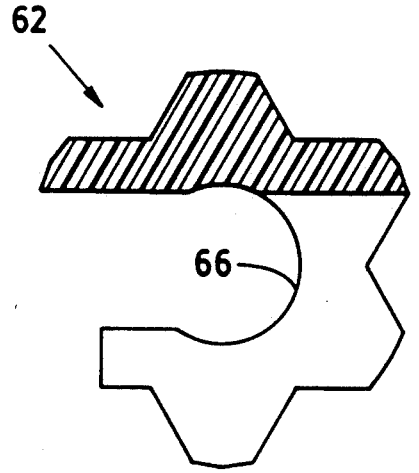
Figure 10:
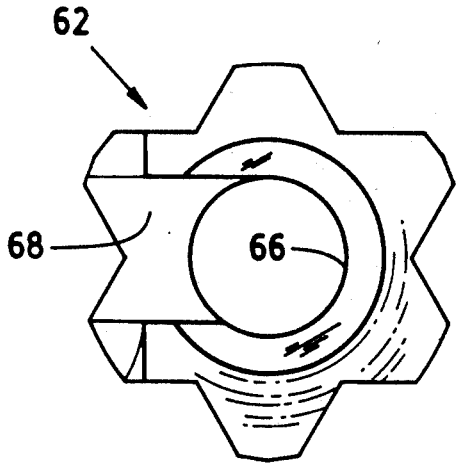
Figure 11:
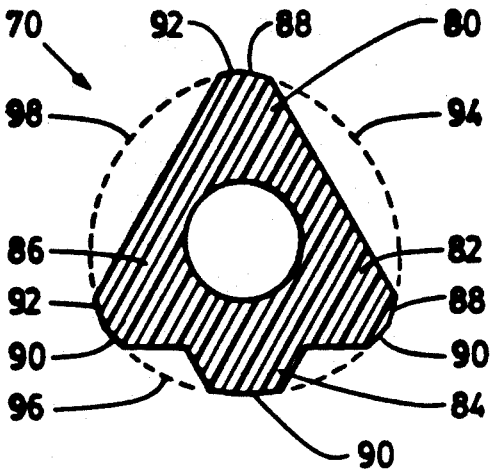
Figure 12:
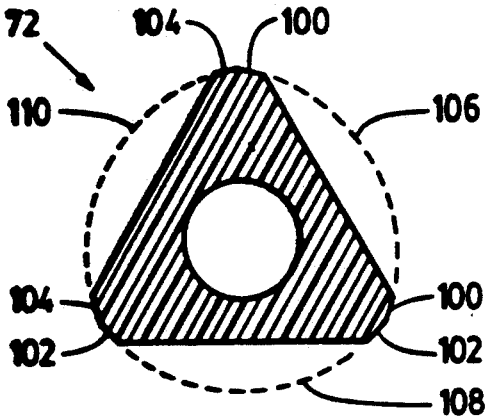
Figure 13:
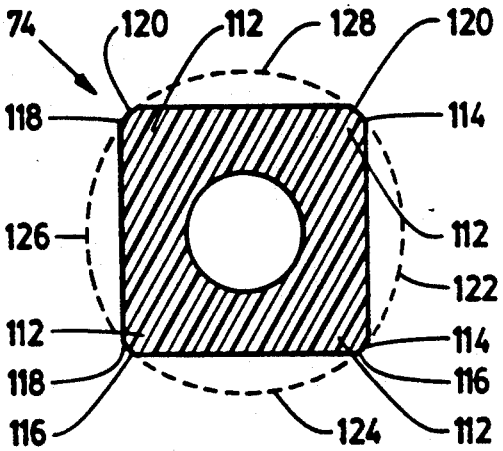
Figure 14:
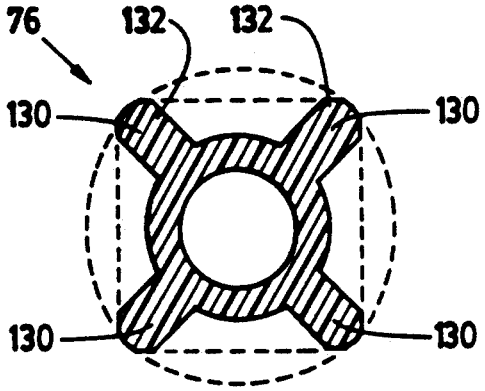
Figure 15:
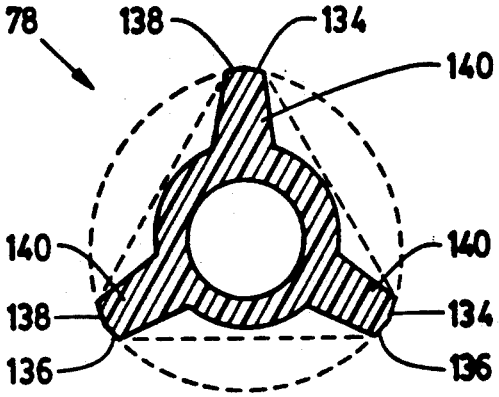

FIG is a top plan view of the centralizer of FIG. 7;

FIG. 9 is a cross section of the centralizer of FIG. 7 taken along line 9—9 of FIG. 7;

FIG. 10 is a bottom plan view of the centralizer of FIG. 7; and

FIGS. 11 to 15 are cross sectional views similar to that of FIG. 9 of third, fourth, fifth, sixth and seventh embodiments, respectively, of the present invention.

DETAILED DESCRIPTION OF PREFERRED EMBODIMENTS

Figure 1:
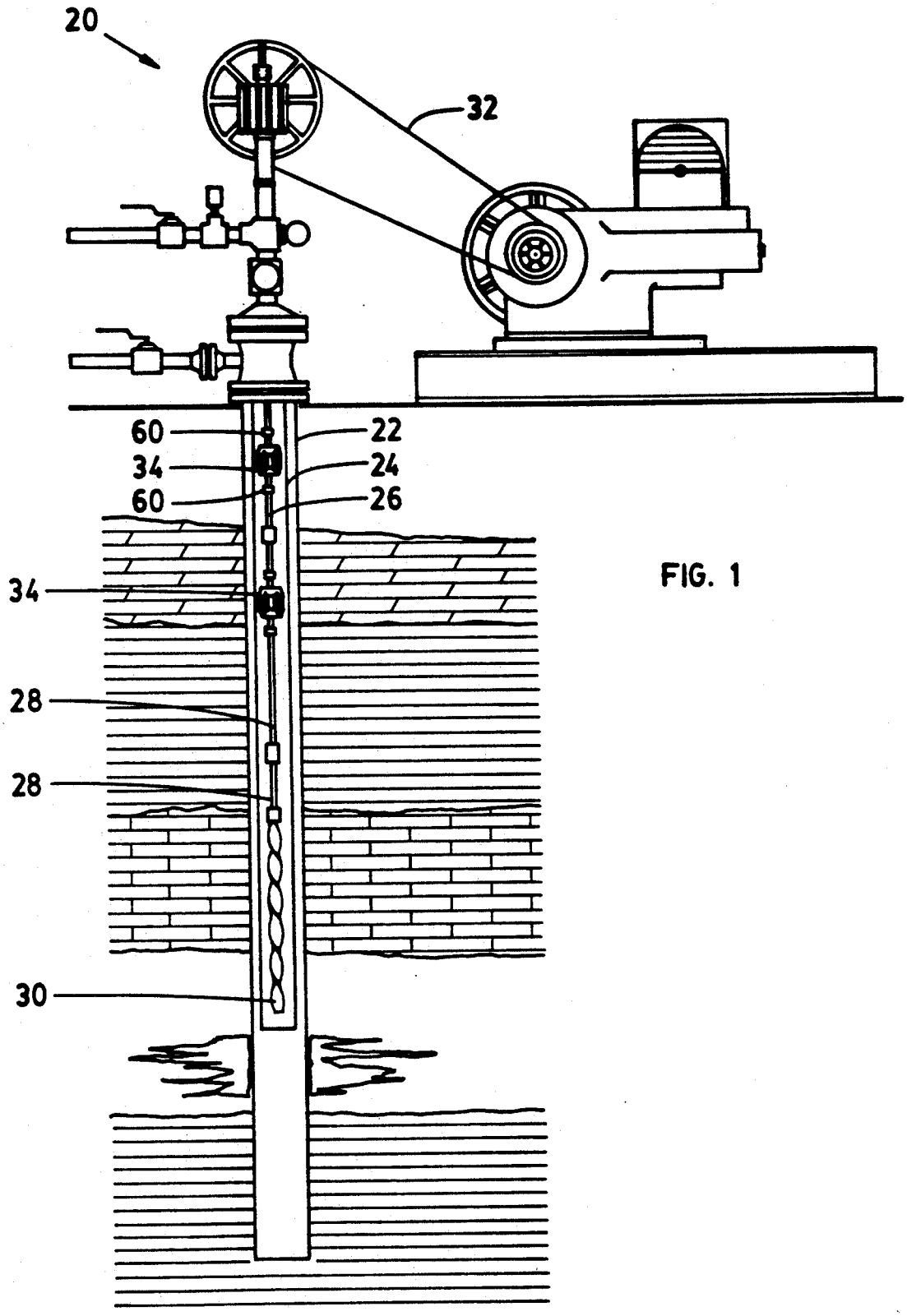
FIG. 1 is a partial cutaway view showing components of a typical well incorporating a rotational sucker rod string.
Figure 2:
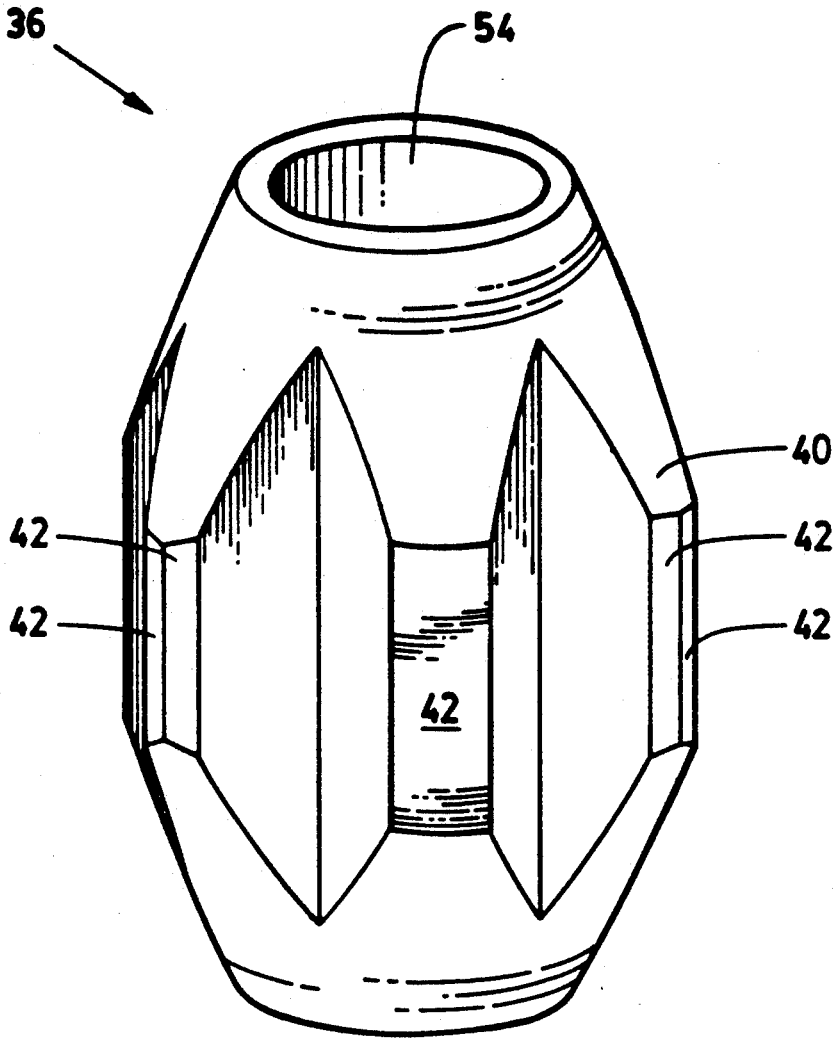
FIG. 2 is a perspective of a first preferred embodiment centralizer of the present invention.
Figure 3:
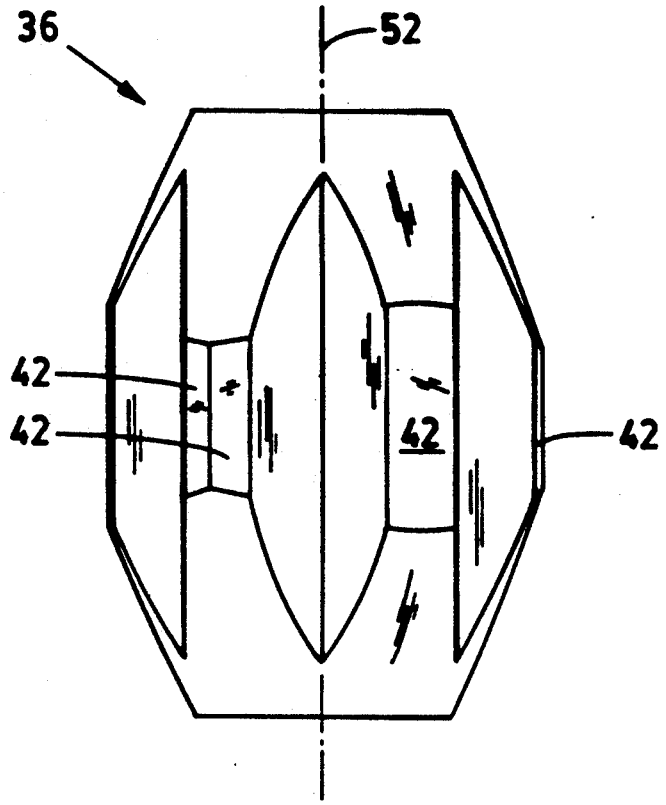
FIG. 3 is a side elevation of the centralizer of FIG. 2.
Figure 4:
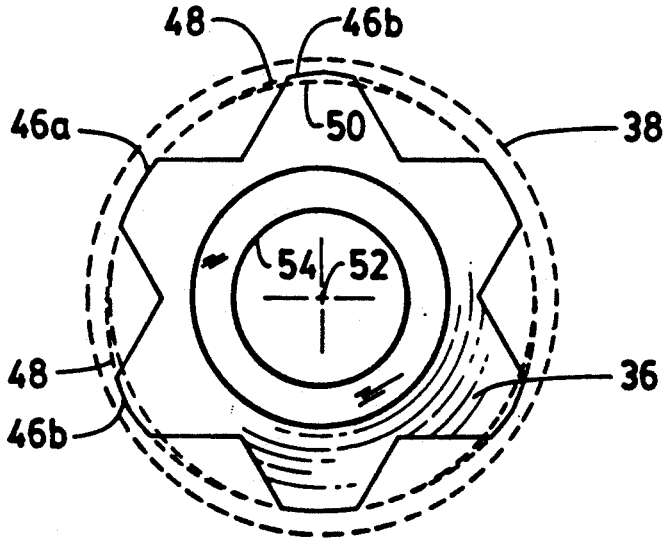
FIG. 4 is a top plan view of the centralizer of FIG. 2.
Figure 5:
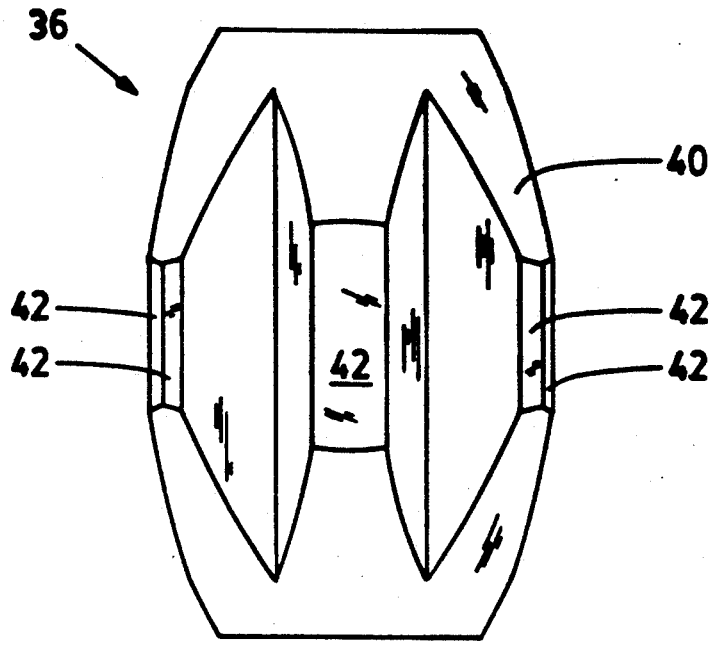
FIG. 5 is a side elevation of the centralizer of FIG. 2 as seen from below FIG. 4.

Turning to the drawings, FIG. 1 illustrates a typical well 20 having wall 22 longitudinally lined with tubing 24. Rod string 26, made up of rods 28 connect pump 30, the string and pump being rotationally driven by motor and gear arrangement 32. The rod string is centralized within the tubing by centralizers indicated generally by numeral 34.

FIGS. 2 to 6 illustrate a first embodiment centralizer 36 of the present invention. The curvature of the interior surface of the well tubing with which the centralizer is to be used is illustrated by the dashed line 38 of FIG. 4. The centralizer has six lobes 40. Surfaces 42 of the lobes are shaped to match the curvature of the tubing 44 of the well wall with which the centralizer is to be used. The longitudinally central portion of the centralizer is cylindrical and has an external cross section such that neighbouring surfaces 46a, 46b define portions of a convex arc indicated by dashed line 48 shown in FIG. 4. Dashed lines 38 and 48 have the same radii of curvature, that is, they substantially match each other in shape. The overall cross dimension of the centralizer is less than the inner diameter of the tubing. The radius of curvature of arc 48 is thus greater than the radius of curvature of circle 50. Circle 50 is concentric with central longitudinal axis 52, and circle 50 and arc 48 are tangential to each other.

Figure 6:
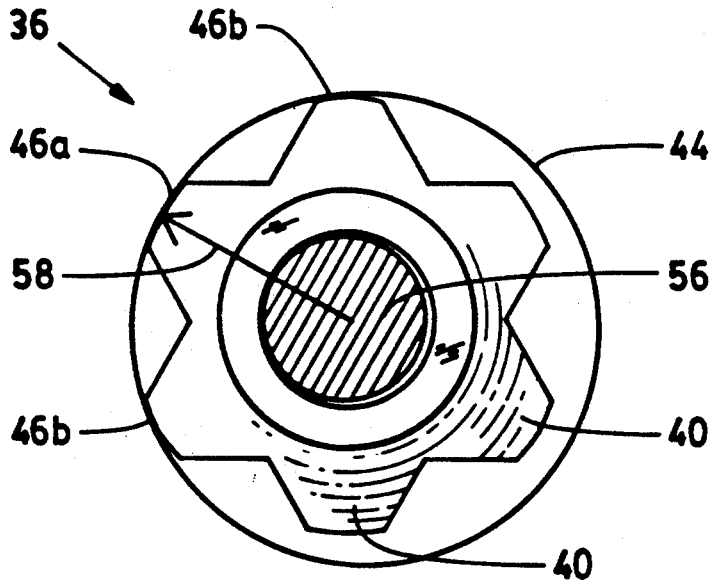
FIG. 6 is a view similar to that of FIG. 4 in which the centralizer of FIG. 2 is in an abutted non-rotational position with respect to a well wall.

Centralizer 36 has an opening provided by central circular bore 54. Bore 54 is sized to accommodate circular rod 56 such that the centralizer may rotate with respect to the rod. When rod 56 moves off center with respect to tubing 44, as when the rod becomes deformed under operational stress, contact surfaces 46a, 46b come into abutting contact with the interior of the well tubing as shown in FIG. 6. Forces are such that the centralizer is held against the well tubing, that is, as indicated by radial force vector 58 Because the shape of the abutting surfaces match each other the centralizer does not rotate with the rotating rod when in such a position. As shown in FIG. 6, there are three centralizer surfaces 46a, 46b matchingly abutting the well tubing. Movement of centralizer 36 is limited in an axial or longitudinal direction along the rod by stops 60, each of which is axially fixed to its rod. See FIG. 1.

The inner diameter of centralizer 36 is slightly greater than the outer diameter of rod 56. Typically, a rod having an outer diameter of $\frac{7}{8}$ inches would be fitted with a centralizer having bore 54 with an inner diameter of about an inch, but this may of course be varied as desired A conventional sucker rod is upset at each of its ends to permit threading for fastening to other rods, etc., and each end thus has a cross-sectional diameter greater than the central portion of the rod. The difference between the diameters of the centralizer and rod is generally not great enough to permit sliding of the centralizer onto the rod. Centralizer 36, as illustrated, is of unitary plastic construction and is manufactured in place on the rod by injection molding. Typically a plastic such as polyphenylene sulphide is suitable.

Alternatively, a centralizer may be manufactured in two, or possibly more, pieces for field assembly onto a rod.

A second embodiment centralizer 62 of unitary construction is illustrated in FIGS. 7 to 10. Centralizer 62 provides transverse slot 64 in communication with central bore 66 and longitudinal openings 68 so that the centralizer may be installed onto a rod in the field. The centralizer is oriented with a rod such that the rod and transverse slot 64 are aligned for radial passage of the rod into the transverse slot. The centralizer is then turned with respect to the rod through longitudinal openings such that the central axis of the centralizer bore is brought into alignment with the central axis of the rod. This sort of rod and centralizer assembly is disclosed in U.S. Pat. No. 3,186,773, issued Jun. 1, 1965 to Donald E. Sable et al. Turning movement of the centralizer with respect to a rod on which it is mounted is sufficiently limited in use by the presence of well tubing that centralizer 62 will remain assembled with its rod within a well tubing.

FIGS. 11 to 15 illustrate cross sections of centralizers 70, 72, 74, 76 and 78, respectively. All embodiments are shaped to have surfaces which may abut a well wall in analogy to the explanation given in connection with the first embodiment centralizer 36.

Third embodiment centralizer 70 has lobes 80, 82, 84, 86 defining surfaces 88, 90, 92, shown in cross section. As indicated, surfaces indicated by the same reference numerals together define portions of arcs 94, 96, 98, resepectively, matching the curvature of a well wall with which the centralizer is to be used as described in connection with centralizer 36.

Fourth embodiment centralizer 72, has a generally triangular middle cross section. Corners of the centralizer define rounded surfaces 100, 102, 104 defining portions of three arcs 106, 108, 110 such that engagement of a well tubing by surfaces 100, for example, or 102, will limit rotation of the centralizer with respect to the well tubing while the rod on which it is rotatably mounted rotates.

Fifth embodiment centralizer 74 has a mid external cross section generally defining a square with rounded corners 112, neighboring corners defining surfaces 114, 116, 118, 120, which in cross section define portions of common arcs 122, 124, 126, 128, respectively. Surfaces defining a common arc are shaped to match and thereby engage a well wall or tubing in use to limit rotation of the centralizer as the rod on which it is rotatably mounted rotates within the well.

Sixth embodiment centralizer 76 has an external cylindrical cross section defining corners 130, in analogy to fifth embodiment centralizer 74. Portions are cut away between the corners such that the centralizer includes lobes 132 having gaps therebetween for passage of reservoir material therethrough.

Seventh embodiment centralizer 78 has a cross section defining paired lobal surfaces 134, 136, 138, to engage a well tubing in a similar manner to that of fourth embodiment centralizer 72. There are indentations such that lobes 140 are defined.

In operation then, any of the illustrated centralizers rotates with its rod until it is brought into contact with the well tubing. The centralizer will rotate with respect to the tubing until surfaces are brought into engagement with the well tubing surfaces such that the centralizer remains stationary with respect to the tubing while the rod continues to rotate.

It will be appreciated that there are many configurations of exterior surface shapes which will function as described in connection with the disclosed embodiments. It will further be appreciated that centralizers having radially extending lobes with gaps therebetween may Provide advantageous characteristics with respect to the flow of reservoir material upwardly past the centralizer.

What is claimed is:

1. A centralizer for use in a downhole well having a wall and a rotatable rod string connected to a downhole pump, which centralizer comprises:

a body having an opening for rotatable mounting to a rod of the rod string; and a plurality of exterior contact surfaces for engagement of the wall;

wherein the centralizer is shaped to have a cross-section such that the contact surfaces together define portions of an arc which is non-congruent with a circle concentric with a central axis of said opening in said body, so as to engage the wall when brought into abutting contact therewith to limit rotational movement of the centralizer with respect to the wall as the rod rotates.

2. The centralizer of claim 1 wherein the opening is a central axial bore of circular cross section.

3. The centralizer of claim 2 wherein the centralizer is of unitary construction.

4. The centralizer of claim 3 wherein the centralizer has first and second longitudinal openings spaced axially from each other and in communication with the central axial bore, and a transverse slot intermediate the longitudinal openings and in communication with the central axial bore and the longitudinal openings, wherein the slot and openings are dimensioned for radial passage of the rod, the transverse slot located for radial receipt of the rod thereinto and the longitudinal openings located such that the centralizer may be subsequently turned with respect to the rod for passage of the rod through the longitudinal openings and into alignment with the central axial bore.

5. The centralizer of claim 2 further comprising a plurality of lobes wherein each lobe defines a said surface.

6. The centralizer of claim 5 wherein each surface is further shaped to match the shape of the wall.

7. The centralizer of claim 2 wherein the bore has a central axis, the arc has a radius of curvature and is tangential to a circle concentric with the axis, wherein the radius of curvature of the arc is greater than the radius of curvature of the circle.

8. The centralizer of claim 7 wherein there are a plurality of said arcs.

9. A well centralizer for use in a downhole wall having a cylindrical tubing and a rotatable rod string connected to a downhole pump, which centralizer comprises:

a body having an axial bore with a central axis therethrough and an outer radial diameter smaller than the inner diameter of the tubing, to be rotatably mounted to one rod of the rod string; and a plurality of lobes, each lobe defining an outer surface for abutment of the tubing, and the centralizer has a cross section such that at least a pair of the surfaces neighbour each other and define a portion of a convex arc having a radius of curvature and which arc is tangential to a circle concentric with the axis, wherein the radius of curvature of the arc is greater than the radius of curvature of the circle.

10. The centralizer of claim 9 wherein there are two said pairs of surfaces.

11. The centralizer of claim 10 wherein there are three said pairs of surfaces.

12. The centralizer of claim 11 further comprising means for limiting axial movement of the centralizer with respect to the rod.

13. The centralizer of claim 9 wherein there are three pairs of said neighbouring surfaces and three said arcs wherein each pair of surfaces define portions of one of the three arcs.

14. In combination, a well centralizer and rod, for use in a downhole well having a cylindrical tubing and a rotatable rod string connected to a downhole pump, wherein:

the centralizer comprises a body having an axial bore with a central axis therethrough and an outer radial diameter smaller than the inner diameter of the tubing, rotatably mounted to the rod; and the centralizer has a plurality of lobes, each lobe defining and outer surface for abutment of the tubing, and the centralizer has a cross section such that at least a pair of the surface neighbour each other and define a portion of a convex arc having a radius of curvature and which arc is tangential to a circle concentric with the axis, wherein the radius of curvature of the arc is greater than the radius of curvature of the circle.

15. A centralizer for use in a well having cylindrical well tubing and a rotatable rod string, comprising:

a body having an axial bore sized for rotatable mounting on a portion of the rod string;

a plurality of spaced apart lobes extending radially outward from said body, a first set of said lobes each having a generally curved outer radial surface having a radius of curvature corresponding to a circle having a diameter less than a diameter of said well tubing, said circle being concentric with said axial bore, and a second set of said lobes located between adjacent lobes of said first set of lobes, each lobe of said second set of lobes having a radius greater than the radius of said outer radial surfaces of said first set of lobes and having two longitudinal distinct outer surfaces, each said distinct outer surface of said second set of lobes in conjunction with an adjacent lobe of said first set defining a convex arc having a radius of curvature greater than the radius of said outer radial surfaces of said first set of lobes such that one of each of said first and second sets of lobes engage said well tubing when brought into abutment therewith so as to limit rotational movement of the centralizer with respect to the wall as the rod rotates.

16. The centralizer of claim 15 wherein there are six said lobes, and said first and second sets of lobes each comprise three lobes.

* * * * *